US008394041B2

(12) United States Patent
Ferber et al.

(10) Patent No.: US 8,394,041 B2
(45) Date of Patent: Mar. 12, 2013

(54) BODY MASSAGER

(75) Inventors: Roman S. Ferber, West Bloomfield, MI (US); Elizabeth Harrison Meyer, Chicago, IL (US)

(73) Assignee: FKA Distributing Co., LLC, Commerce Township, MI (US)

( * ) Notice: Subject to any disclaimer, the term of this patent is extended or adjusted under 35 U.S.C. 154(b) by 1259 days.

(21) Appl. No.: 12/043,532

(22) Filed: Mar. 6, 2008

(65) Prior Publication Data

US 2008/0262398 A1 Oct. 23, 2008

Related U.S. Application Data

(60) Provisional application No. 60/905,939, filed on Mar. 9, 2007.

(51) Int. Cl.
*A61H 7/00* (2006.01)
*A61H 19/00* (2006.01)

(52) U.S. Cl. ..... 601/101; 601/97; 601/98; 601/103

(58) Field of Classification Search ..... 601/84–87, 601/89–94, 97–103, 112, 113, 115, 116, 601/136, 146; 297/217.4, 273, 284.1, 284.2, 297/284.3, 396, 397
See application file for complete search history.

(56) References Cited

U.S. PATENT DOCUMENTS 2,937,641 A * 5/1960 Oetinger ..... 601/59
4,173,972 A * 11/1979 Kodera ..... 601/102
5,233,973 A * 8/1993 Gill et al. ..... 601/103
5,653,679 A * 8/1997 Belanchi ..... 601/98
5,695,451 A 12/1997 Kawakami
5,741,218 A * 4/1998 Fujii ..... 601/90
5,823,620 A * 10/1998 Le Caz ..... 297/284.4
6,056,707 A * 5/2000 Hayashi ..... 601/99
6,077,238 A * 6/2000 Chung ..... 601/57
6,200,282 B1 3/2001 Furuie
6,805,411 B2 * 10/2004 Gramss et al. ..... 297/408
6,840,914 B1 1/2005 Takamura (Continued)

FOREIGN PATENT DOCUMENTS

CN 1170568 A 1/1998
CN 2319027 Y 5/1999

(Continued)

OTHER PUBLICATIONS

Chinese Office Action for corresponding Application No. 200880007647.X, mailed Jul. 29, 2011, 3 pages.

(Continued)

*Primary Examiner* — Patricia Bianco
*Assistant Examiner* — Raymond G Chen
(74) *Attorney, Agent, or Firm* — Brooks Kushman P.C.

(57) ABSTRACT

One embodiment provides a body massager with a backrest, a lower torso massager, and an upper torso massager. The upper torso massager extends from the backrest for imparting a massage effect to the upper torso of the user. A biasing member is connected to the backrest and the upper torso massager for urging the upper torso massager into contact with the user. Another embodiment provides a body massager with a housing having a first guide oriented generally in a longitudinal direction of the housing. A carriage cooperates with the guide for limited longitudinal translation. A motor translates the carriage along the guide. A second guide is canted relative to a longitudinal direction of the housing. A massage member is supported on the carriage and cooperates with the second guide such that as the carriage is translated along the guide, the massage member is translated transversely relative to the carriage.

16 Claims, 8 Drawing Sheets

U.S. PATENT DOCUMENTS

| | | | | |
|---|---|---|---|---|
| 6,910,735 | B2 * | 6/2005 | Asbach et al. | 297/284.3 |
| 7,060,042 | B2 | 6/2006 | Huang | |
| 7,060,043 | B2 | 6/2006 | Huang | |
| 7,160,261 | B1 | 1/2007 | Huang | |
| 7,285,102 | B1 * | 10/2007 | Chang | 601/98 |
| 7,306,570 | B1 * | 12/2007 | Julian | 601/87 |
| 7,311,681 | B1 * | 12/2007 | Vaccarella et al. | 601/46 |
| 7,854,710 | B2 * | 12/2010 | Liang | 601/98 |
| 2001/0004679 | A1 * | 6/2001 | Ichikawa | 601/98 |
| 2001/0054837 | A1 * | 12/2001 | O'Connor | 297/397 |
| 2002/0177796 | A1 | 11/2002 | Suh | |
| 2002/0183665 | A1 | 12/2002 | Suh | |
| 2003/0199796 | A1 | 10/2003 | Yamazaki et al. | |
| 2003/0212353 | A1 | 11/2003 | Kahn | |
| 2004/0049136 | A1 | 3/2004 | Lin | |
| 2004/0082983 | A1 * | 4/2004 | Park | 607/96 |
| 2004/0106882 | A1 * | 6/2004 | Tseng | 601/86 |
| 2004/0127822 | A1 * | 7/2004 | Eisenberg | 601/49 |
| 2004/0158176 | A1 * | 8/2004 | Park | 601/18 |
| 2005/0116526 | A1 | 6/2005 | VanDeRiet et al. | |
| 2005/0209538 | A1 * | 9/2005 | Lev et al. | 601/15 |
| 2005/0245851 | A1 | 11/2005 | Ferber et al. | |
| 2005/0256434 | A1 | 11/2005 | Luo | |
| 2006/0195052 | A1 * | 8/2006 | Kim | 601/99 |
| 2006/0211962 | A1 | 9/2006 | Ferber et al. | |
| 2007/0027412 | A1 | 2/2007 | Li et al. | |
| 2007/0208284 | A1 * | 9/2007 | Huang | 601/112 |
| 2007/0239090 | A1 * | 10/2007 | Mitea | 601/112 |
| 2007/0299377 | A1 | 12/2007 | Shiraishi | |
| 2008/0132815 | A1 * | 6/2008 | Tsang et al. | 601/91 |

FOREIGN PATENT DOCUMENTS

| | | | |
|---|---|---|---|
| CN | 2587403 | Y | 11/2003 |
| EP | 1145701 | A1 * | 10/2001 |
| JP | 06072218 | A * | 3/1994 |
| JP | 10216187 | A * | 8/1998 |

OTHER PUBLICATIONS

International Preliminary Report for corresponding Application No. PCT/US2008/056027, mailed Sep. 24, 2009, 7 pages.

International Search Report and Written Opinion for corresponding PCT Application No. PCT/US08/56027, mailed Sep. 9, 2008, 8 pages.

* cited by examiner

BODY MASSAGER

CROSS-REFERENCE TO RELATED APPLICATIONS

This application claims the benefit of U.S. provisional application Ser. No. 60/905,939 filed Mar. 9, 2007, the disclosure of which is incorporated in its entirety by reference herein.

BACKGROUND

1. Technical Field

Various embodiments of the invention relate to body massagers.

2. Background Art

The prior art discloses body massagers that provide lengthwise rotary kneading such as U.S. Patent Application Publication Number 2005/0245851 A1, the disclosure of which is incorporated in its entirety by reference herein.

DETAILED DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims, and/or as a representative basis for teaching one skilled in the art to variously employ the present invention.

Figure 1:
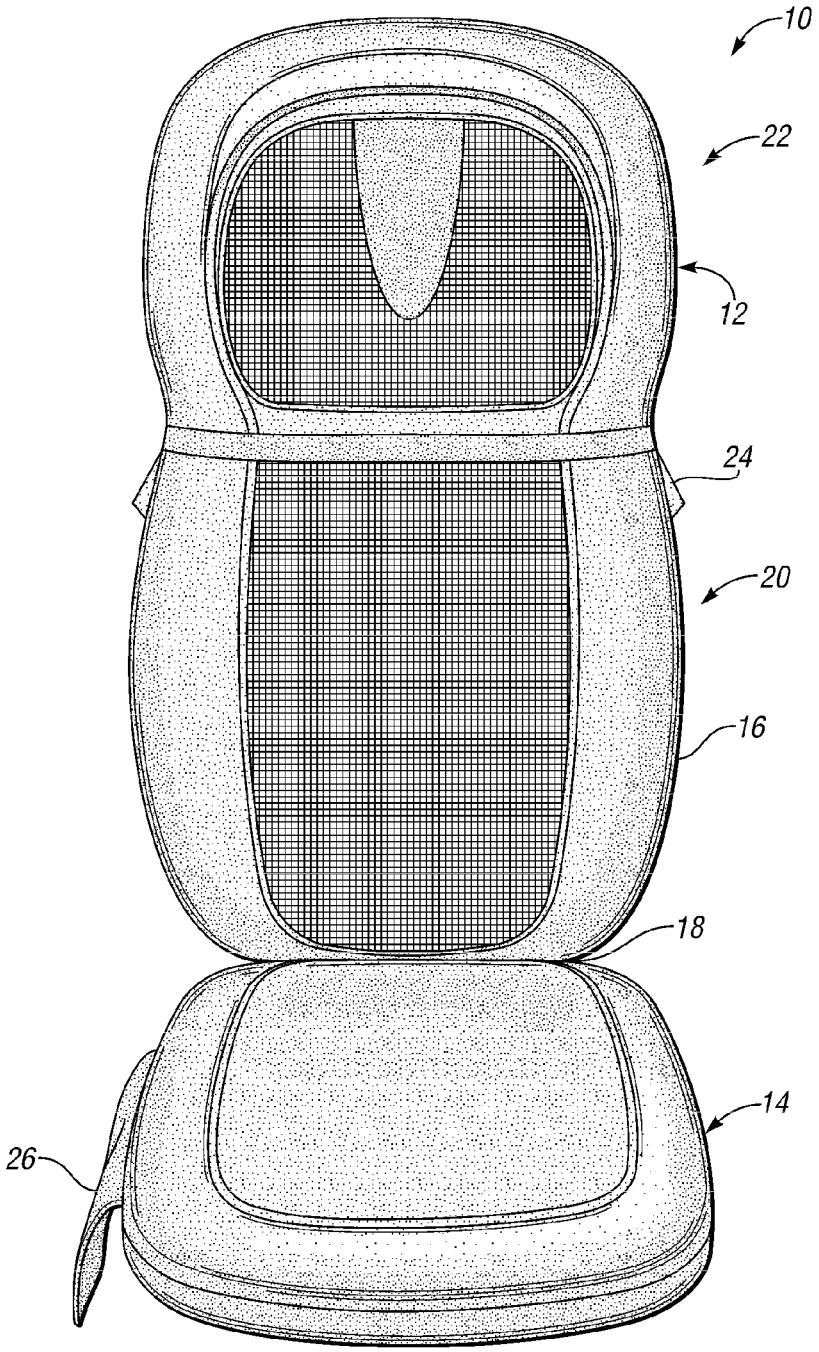
FIG. 1 is a front perspective view of a body massager in accordance with the present invention.

With reference to FIG. 1, an embodiment of a body massager is illustrated in accordance with the present invention and is referenced generally by numeral 10. In at least one embodiment, the body massager 10 is a portable body massager that is sized to be received and supported by a conventional chair. The body massager 10 includes a backrest 12 and a seat support 14. The backrest 12 and seat support 14 are collectively retained within a flexible cover 16, which may be formed of a high quality fabric. Of course, materials such as leather, vinyl, or the like may be employed for the cover 16. The cover 16 provides a pivotal connection 18 at a lower longitudinal end of the backrest 12 and a rearmost end of the seat support 14. The flexible material of the cover 16 provides a living hinge at the pivotal connection 18 permitting user adjustment of an included angle between the backrest 12 and the seat support 14.

Massage effects provided by the body massager 10 include a lower torso massage effect, such as a rotary kneading massage effect provided in a lower torso region 20 of the backrest 12. The lower torso massage effect may be operable to provide a rotary kneading massage effect longitudinally along the length of the lower torso region 20. The body massager 10 may also include an upper torso massage effect provided in a upper torso region 22 of the backrest 12. The upper torso massage effect may be operable to provide a rotary kneading massage effect longitudinally along the length of the upper torso region 22.

In at least one embodiment, the backrest 12 is sized to be received upon a backrest of a conventional chair. Likewise, the seat support 14 is sized to be received upon a seat support of a conventional chair. The lower torso region 20 of the backrest 12 is sized to receive and support a lower torso region of a user, such as the pelvic and lumbar regions of the torso. The upper torso region 22 is sized to receive an upper torso region of the user, such as the shoulders and neck.

In at least one embodiment, the body massager 10 is portable due to its compact size and light weight so that the user may place the body massager 10 upon a conventional chair for receiving a massage when seated upon the chair. The adjustability of the included angle between the backrest 12 and the seat support 14 accommodates a wide range of angles that may be incorporated in conventional chairs. Alternatively, the body massager 10 may be utilized without a chair for various seating and resting positions.

The backrest 12 includes a height and width corresponding to the conventional chair and has a thickness that is adequate for housing massage assemblies therein while avoiding disruption of comfort and support provided by the underlying chair. Likewise, the seat support 14 has a width and a depth corresponding to that of the conventional seat support and has a thickness that is adequate for housing a cushion while avoiding disruption of comfort and support provided by the underlying chair. Additionally, the backrest 12 includes a pair of straps 24 mounted from its lateral sides for securing the body massager 10 to the conventional chair. The straps 24 each include one of a hook and loop material for securing the straps 24 about the backrest of the conventional chair. Of course, any engagement mechanism is contemplated, such as a belt buckle, a clip, or the like.

By way of example, the backrest 12 has a height of approximately twenty-nine inches, an overall width of approximately sixteen and one-half inches, and a thickness of approximately three and one-third inches. Of course, the invention contemplates that the body massager 10 may have dimensions adequate to be received by any conventional chair, and/or may have dimensions to receive and support the user.

The body massager 10 further includes a manual remote control (not shown) connected to the massager 10 for controlling the massage operations. The cover 16 has a pocket 26 mounted to a lateral side of the seat support 14 so that the remote may be conveniently retained when not in use.

Figure 2:
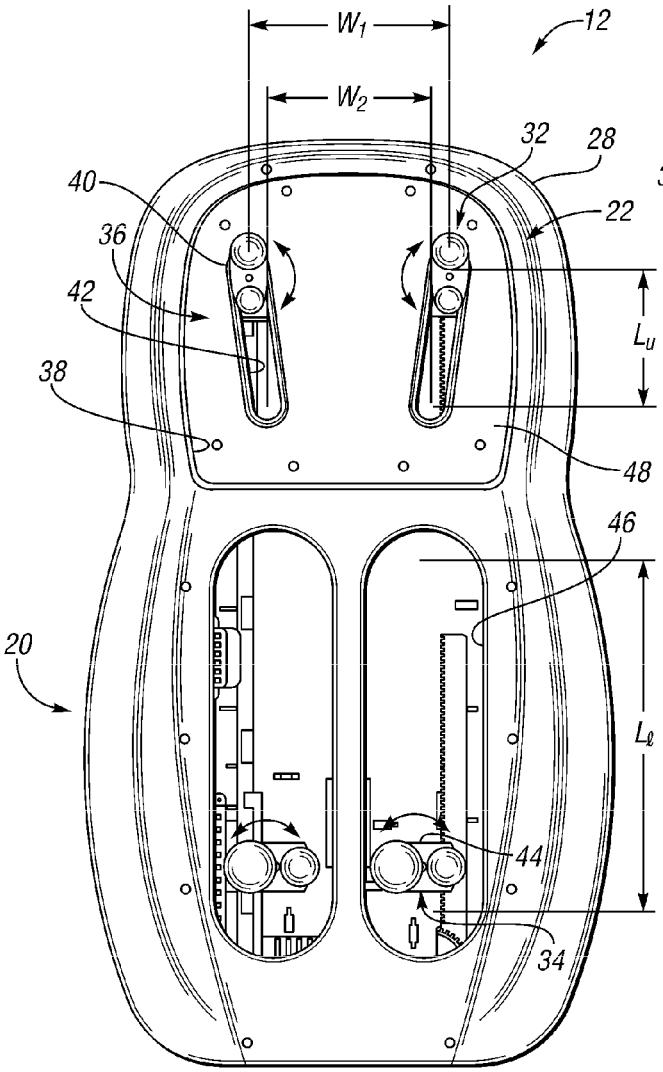
FIG. 2 is a front elevation view of a backrest of the body massager of FIG. 1, illustrated with a cover removed therefrom.
Figure 3:
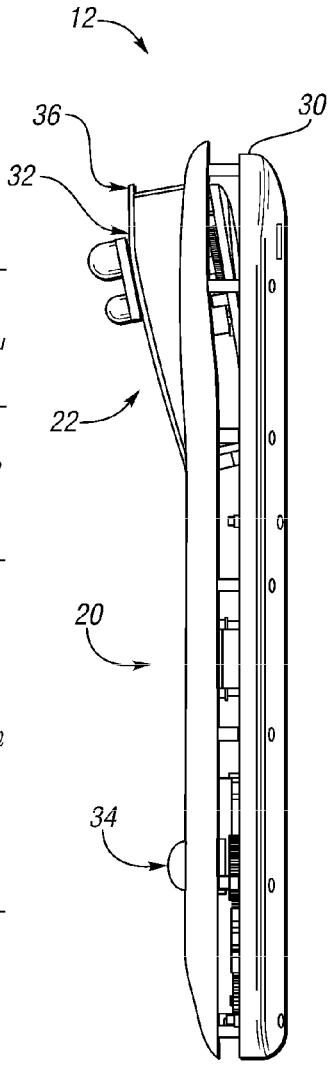
FIG. 3 is a side elevation view of the backrest of FIG. 2.

Referring now to FIGS. 2 and 3, the backrest 12 is illustrated removed from the cover 16. The backrest 12 includes a two-piece housing provided by a front housing portion 28 and a rear housing portion 30. The front housing portion 28 and the rear housing portion 30 are sized to be secured together by a plurality of fasteners for retaining components of a upper torso massager 32 and a lower torso massager 34 within the backrest 12. The front housing portion 28 provides the external contact surface for the back of the user and therefore may be covered with foam, cushioning, or the like for providing comfort and support to the user.

The upper torso massager 32 has a housing 36 that is oriented within the backrest housing portions 28, 30. The front housing portion 28 has an opening 38 formed through the external contact surface for receiving the upper torso massager housing 36. Likewise, the upper torso massager housing 36 has an external contact surface, which collectively provides an external contact surface with the backrest 12. The upper torso massager housing 36 is pivotally connected to the front housing portion 28 at a lower longitudinal region of the upper torso massager housing 36. This pivotal connection permits the upper torso massager housing 36 to extend through the opening 38 as illustrated in FIG. 3. The pivotal connection of the upper torso massager housing 36 to the front housing portion 28 of the backrest 12 permits a range of positions of the upper torso massager 32 relative to the lower torso massager 34 for various body sizes and shapes. Additionally, a biasing member, such as a spring, is provided between the upper torso massager housing 36 and the rear housing portion 30 of the backrest 12 to urge the upper torso massager housing 36 forward to maintain contact between the upper torso massager 32 and the user. The spring also provides compliancy so that the upper torso massager 32 may retract when rested against, and extend to maintain contact with the user. By way of example, the upper torso massager housing 36 has a range of pivotal rotation from generally flush with the opening 38 to twelve degrees forward for maintaining contact with various body sizes and shapes.

In at least one embodiment, the upper torso massager 32 is a rotary kneading massager with a pair of massage heads 40 each extending from the upper torso massager housing 36. The massage heads 40 are each driven to rotate relative to the upper torso massager housing 36 for collectively providing a rotary kneading massage effect. For example, the massage heads 40 may be counter-rotating for providing a shiatsu massage effect. As will be discussed below, the massage heads 40 are driven longitudinally along a first guide 60 to provide a rolling massage effect upon a length $L_U$ of the upper torso region 22 for providing a rolling massage effect. As the massage heads 40 are also rotated, a longitudinal rotary kneading massage effect may be provided. In one embodiment, LU is approximately four and one-third inches.

Additionally, the massage heads 40 may be driven to diverge at an upper region of travel, and converge at a lower region of travel as illustrated by the paths of travel of a second guide in FIG. 2, which may be embodied by slots 42 formed through the upper torso massager housing 36. The slots 42 are each angled relative to the longitudinal direction of the upper torso massager housing 36. A transverse width of the massage heads 40 ranges from $W_1$ to $W_2$ in FIG. 2. In one embodiment, $W_1$ is approximately six and one-quarter inches and $W_2$ is approximately five inches. This varying width provides a rolling massage effect in the upper torso region of the user that converges between the shoulders and the lumbar and diverges at an upper region of the shoulders and lower region of the neck. Due to the pivotal connection of the upper torso massager housing 36 with the front housing portion 28 of the backrest 12, the upper torso massager 32 may extend and retract from the backrest 12 during the rotary kneading massage effect of the massage heads 40, the rolling massage effect of the massage heads 40, or the longitudinal rotary kneading massage effect of the massage heads 40 to maintain the massage heads 40 in contact with the user while providing compliancy during the massage effect.

The lower torso massager 34 also includes a pair of massage heads 44 that are spaced about a center longitudinal axis of the backrest 12 and are driven to provide a rotary kneading massage effect. Additionally, the massage heads 44 may be driven along a length $L_L$ of the lower torso region 20 to provide a rolling massage effect. Additionally, the massage heads 44 may be driven to rotate as they roll along the length $L_L$ to provide a longitudinal rotary kneading massage effect. The front housing portion 28 includes a pair of longitudinal apertures 46 formed therethrough so that the massage heads 44 of the lower torso massager 34 may extend out of the backrest 12.

Figure 4:
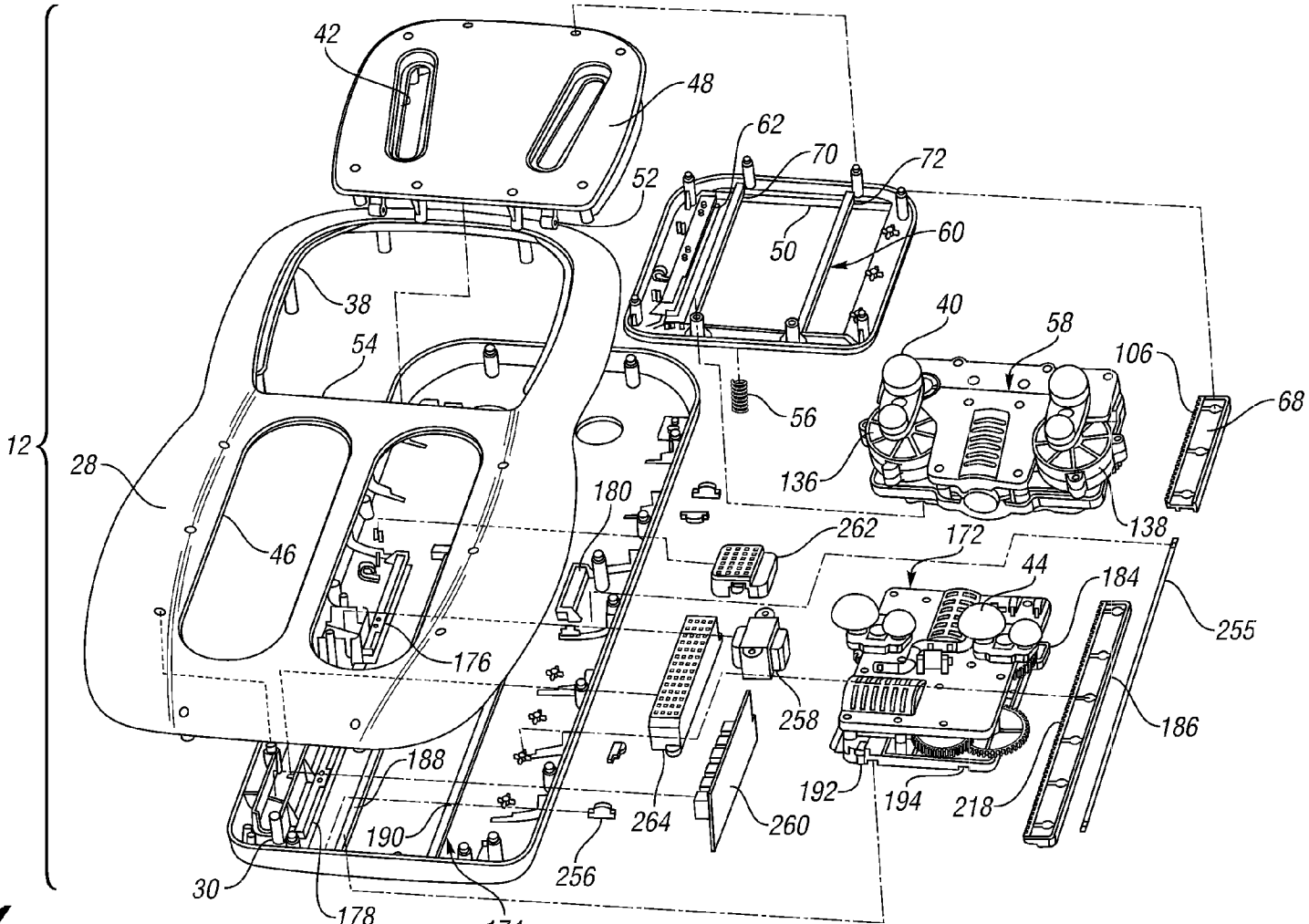
FIG. 4 is a partially exploded perspective view of the backrest of FIG. 2.

Referring now to FIG. 4, the backrest 12 is illustrated partially exploded with the front housing portion 28 disassembled from the rear housing portion 30. Likewise, the upper torso massager housing 36 is disassembled with a front housing portion 48 and a rear housing portion 50. The front and rear housing portions 48, 50 of the upper torso massager 32 may be assembled together by fasteners or the like. The front housing portion 48 of the upper torso massager 32 has a first hinge portion 52 formed along a lower longitudinal end, which cooperates with a second hinge portion 54 formed at a lower longitudinal end of the opening 38 such that the front housing portion 48 of the upper torso massager 32 is pivotally connected to the front housing portion 28 of the backrest 12 to pivot about a transverse axis. A coil spring 56 is provided between the rear housing portion 50 of the upper torso massager 32 and the rear housing portion 30 of the backrest 12 to urge the upper torso massager 32 to the extended position.

The upper torso massager 32 includes a carriage 58 which cooperates with the rear housing portion 50 of the upper torso massager 32 for limited longitudinal translation within the upper torso massager housing 36. The rear housing portion 50 of the upper torso massager 32 includes the longitudinal first guide 60 for cooperating with the carriage 58. The first guide 60 includes a first gib 62 that cooperates with and retains a first longitudinal key 64 (FIG. 5) extending from the carriage 58. The carriage 58 includes a second longitudinal key 66 (FIG. 5) extending laterally from the carriage 58 in transversely spaced opposition to that of the first key 64. The second key 66 is retained relative to the rear housing portion 50 of the upper torso massager 32 by a longitudinal retainer gib 68, which is secured to the rear housing portion 50 of the upper torso massager 32 by a series of fasteners or the like.

The first guide 60 of the rear housing portion 50 of the upper torso massager 32 has a pair of longitudinal rails 70, 72 extending upward from the rear housing portion 50. A pair of keyways 74, 76 (FIG. 5) are formed longitudinally through the carriage 58. The keyways 74, 76 are sized to receive the rails 70, 72, respectively. The cooperation of the rails 70, 72 and the keyways 74, 76 provides transverse guidance and support to the carriage 58 as the carriage 58 translates along the guide 60.

Figure 5:
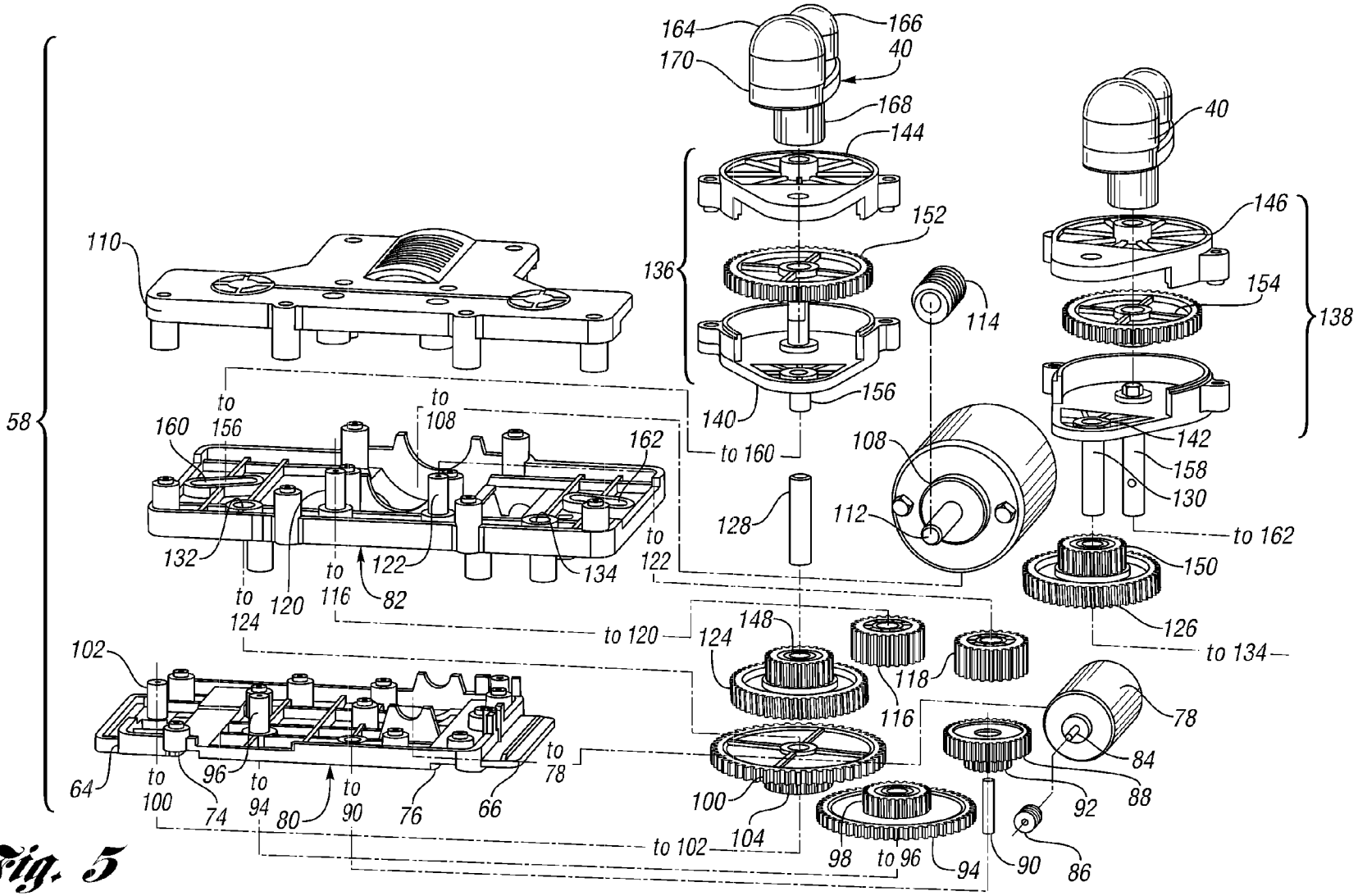
FIG. 5 is an exploded perspective view of a neck massager of the backrest of FIG. 2.

FIG. 5 illustrates one embodiment of the carriage 58 in greater detail. The carriage 58 includes a first motor 78, which is retained within a motor mount collectively provided by a lower plate 80 and an intermediate plate 82 of the carriage 58. The first motor 78 is operable to translate the carriage 58 along the guide 60 of the rear housing portion 50 of the upper torso massager 32. The first motor 78 includes a motor output shaft 84 that drives a worm 86 that is mounted on the shaft 84. The worm 86 drives a worm gear 88 that is mounted to the lower and intermediate carriage plates 80, 82 about a shaft 90.

A first pinion gear 92 is mounted to the underside of the worm gear 88 and driven by the worm gear 88. A first reduction gear 94 is mounted for rotation upon a post 96 on the lower carriage plate 80. The first reduction gear 94 includes a second pinion gear 98 mounted to its upper side and driven with the first reduction gear 94. The second pinion gear 98 engages a second reduction gear 100 that is rotatably driven about post 102 on the lower carriage plate. A third pinion gear 104 is mounted to an underside of the second reduction gear 100. The third pinion gear 104 is engaged to a gear rack 106 (FIG. 4) formed along the retainer gib 68.

The worm 86, worm gear 88, first pinion gear 92, first reduction gear 94, second pinion gear 98, second reduction gear 100, third pinion gear 104, and gear rack 106 provide a transmission such that rotation from the motor output shaft 84 experiences multiple stages of reduction for reduced rotation of the third pinion gear 104 relative to the motor output shaft 84. Since the rack 106 is fixed relative to the guide 60, rotation of the third pinion gear 104 translates the carriage 58 along the guide 60. Accordingly, the rotation of the motor output shaft 84 results in translation of the carriage 58 along the guide 60 due to engagement with the gear rack 106. Of course, various transmission arrangements are contemplated within the scope of the present invention.

The upper torso massager 32 also includes a second motor 108, which is mounted to the intermediate plate 82 of the carriage 58 and retained by a cover plate 110. The cover plate 110 and the intermediate plate 82 collectively define a motor mount for the second motor 108 and are fastened together by a plurality of fasteners. The second motor 108 is operable to impart a rotary massage effect from the upper torso massager 32. The second motor 108 includes a motor output shaft 112, which provides an input rotation and drives a worm 114 mounted on the shaft 112. The worm 114 drives a pair of input gears or worm gears 116 that rotate about posts 120, 122 on the intermediate plate 82. The worm 114 drives the worm gears 116, 118 in opposed rotational directions. Each worm gear 116, 118 is engaged with another worm gear 124, 126 (or first reduction gear), which are each rotatably mounted to the intermediate plate 82 by a first drive shaft 128, 130. The first drive shafts 128, 130 are each received within an aperture 132, 134 in the intermediate plate 82.

In at least one embodiment, the carriage 58 includes a pair of translatable gearboxes 136, 138. Each gearbox 136, 138 includes a gearbox housing with a lower gearbox portion 140, 142 and an upper gearbox portion 144, 146 fastened to the lower gearbox portion 140, 142. The gearboxes 136, 138 are each pivotally connected to one of the first drive shafts 128, 130, respectively, for pivoting relative to the carriage 58. A pinion gear 148, 150 is provided within each gearbox 136, 138 and is driven about the respective first drive shaft 128, 130. Thus, as each of the worm gears 124, 126 drives the corresponding first drive shafts 128, 130, the pinion gears 148, 150 are driven within the associated gearboxes 136, 138. A reduction gear 152, 154 is provided within each of the gearboxes 136, 138 and is engaged by the corresponding pinion gear 148, 150 and driven thereby. Each of the reduction gears 152, 154 is mounted to a second drive shaft 156, 158 that extends through the corresponding upper gearbox portion 144, 146 and drives one of the massage heads 40 with an output rotation. Each of the second drive shafts 156, 158 extends through the corresponding lower gearbox portion 140, 142 into an arcuate slot 160, 162 for permitting each gearbox 136, 138 to pivot relative to the intermediate plate 82 of the carriage 58. Various transmission arrangements are contemplated by the present invention in order to obtain a desired rotary speed and output torque.

Each massage head 40 includes a large massage node 164 and a small massage node 166. Each massage head 40 includes a boss 168 extending from the underside thereof that is mounted upon the corresponding second drive shaft 156, 158. Each boss 168 is received in the corresponding angled slot 42 of the front housing portion 48 of the upper torso massager 32 for guiding the massage head 40 and corresponding gearbox 136, 138 within the slots 42.

As the massage nodes 164, 166 revolve around the corresponding second drive shaft 156, 158, a rotary kneading massage effect is imparted upon the user, which is commonly referred to as a shiatsu massage effect. Each massage node 164, 166 may be rotatably connected to a massage bracket 170 to reduce friction generated in the rotary kneading massage effect. Further, if the first motor 78 is in operation while the second motor 108 is not in operation, the massage nodes 164, 166 are translated in engagement along the body part of the user. The rotatable connection permits the massage nodes 164, 166 to roll along the body part thereby creating a rolling massage effect. Operation of both motors 78, 108 results in a longitudinal rotary kneading massage effect.

The large massage nodes 164 have an overall height greater than that of the small massage nodes 166 to extend further from the corresponding massage brackets 170. The large massage node 164 also has a diameter greater than that of the small massage node 166. These variations are utilized for varying the engagement of the rotary kneading massage effect with the user, resulting in a kneading effect that is non-symmetrical and similar to a massage provided by the hands of a skilled massage therapist. Additionally, these variations result in a non-symmetrical rolling massage effect as the nodes 164, 166 are rolled along the body. Additionally, as the carriage 58 translates upward and downward, the massage heads 40 diverge and converge for varying the width of the rotary or kneading massage effect due to the slots 42, which act as a transverse guide. The depicted embodiment is an exemplary mechanism for varying the width of the massage heads 40 but should not be construed as limiting.

Referring again to FIG. 4, the lower torso massager 34 also includes a carriage 172. The lower torso massager 34 is similar to the portable body massager of Ferber et al. disclosed in U.S. Patent Application Publication No. 2006/0211962 A1, filed on Aug. 17, 2005 and published on Sep. 21, 2006, which is incorporated in its entirety by reference herein. The carriage 172 cooperates with the rear housing portion 30 for a limited longitudinal translation within the backrest 12. Accordingly, the rear housing portion 30 includes a longitudinal guide 174 for cooperating with the carriage 172. The guide 174 includes a series of gibs indicated and referenced as left upper gib 176, left lower gib 178, and right upper gib 180. The left gibs 176, 178 cooperate with and retain a first longitudinal key 182 (FIG. 6) formed laterally along the carriage 172. The carriage 172 includes a second longitudinal key 184 extending laterally therefrom in transversely spaced opposition to that of the first key 182. The second key 184 is retained relative to the rear housing portion 30 by the right upper gib 180 and by a retainer gib 186, which is secured to the rear housing portion 30 by a series of fasteners.

The guide 174 further includes a pair of longitudinal rails 188, 190 extending upward therefrom. A pair of keyways 192, 194 are formed longitudinally through the carriage 172. The keyways 192, 194 are sized to receive the rails 188, 190, respectively. The cooperation of the rails 188, 190 and the keyways 192, 194 provides transverse guidance and support to the carriage 172 as it translates along the guide 174.

Figure 6:
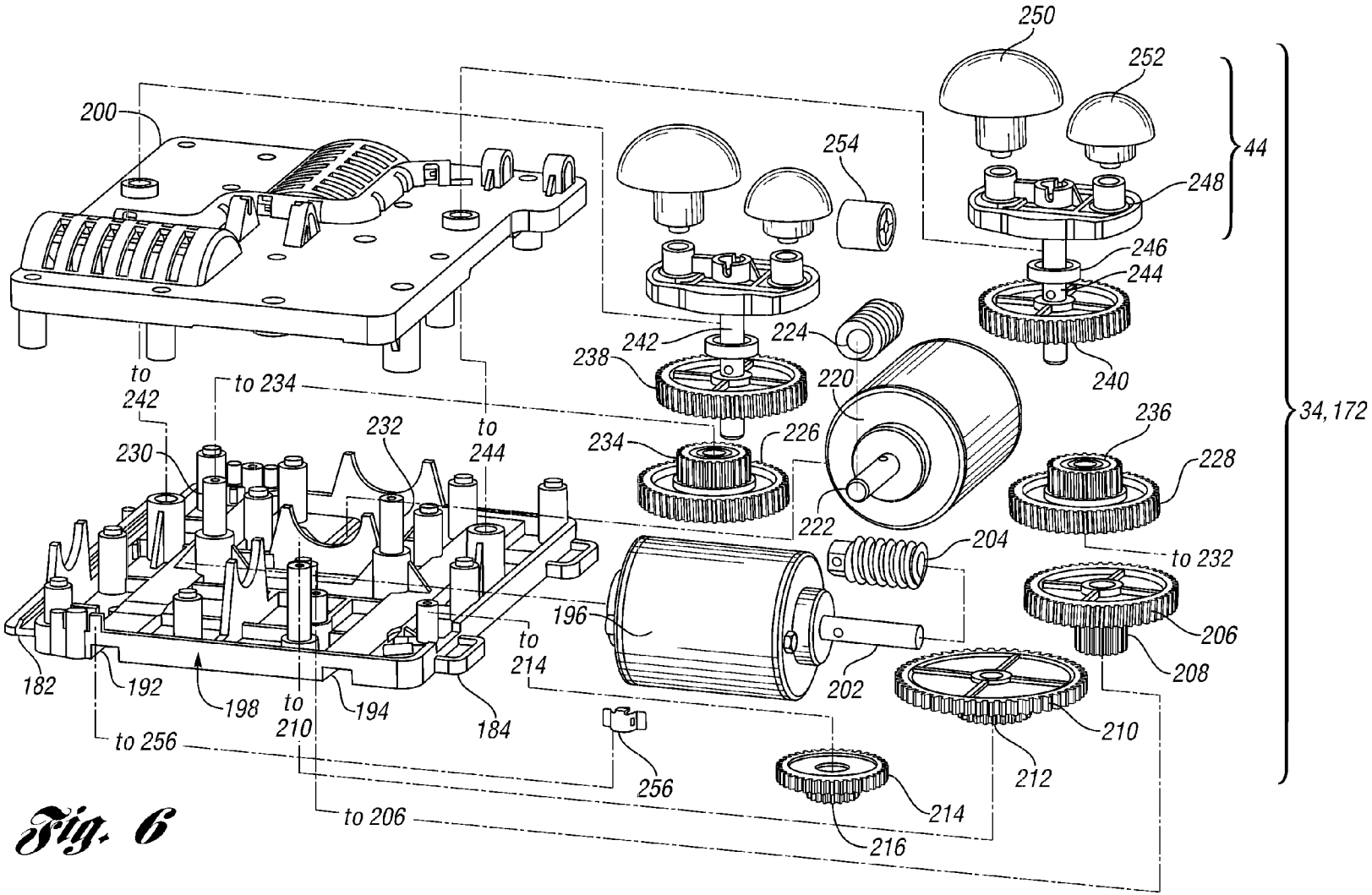
FIG. 6 is an exploded perspective view of a torso massager of the body massager of FIG. 2.

With reference now to FIG. 6, at least one embodiment of the lower torso massager 34 is illustrated in greater detail. The lower torso massager 34 includes a first motor 196, which is mounted to a lower plate 198 of the carriage 172 and retained by a cover plate 200. The cover plate 200 and the lower plate 198 collectively define a motor mount for the first motor 196 and are fastened together by a plurality of fasteners. The first motor 196 is operable to translate the carriage 172 along the guide 174 of the rear housing portion 30. The first motor 196 includes a motor output shaft 202 for driving a worm 204 mounted to the shaft 202. The worm 204 drives a worm gear 206 that is mounted to the carriage 172 for rotation. A first pinion gear 208 is mounted to the underside of the worm gear 206 and driven with the worm gear 206. A first reduction gear 210 is rotatably mounted upon the carriage 172 and is engaged with the first pinion gear 208. A second pinion gear 212 is mounted to an underside of the first reduction gear 210 and is engaged with a second reduction gear 214. The second reduction gear 214 is rotatably mounted to the carriage 172 and includes a third pinion gear 216 mounted to its underside. The third pinion gear 216 is engaged to a gear rack 218 (FIG. 4) formed along the retainer gib 186.

The worm 204, worm gear 206, first pinion gear 208, first reduction gear 210, second pinion gear 212, second reduction gear 214, third pinion gear 216, and gear rack 218 provide a transmission such that rotation from the motor output shaft 202 experiences multiple stages of gear reduction for reduced rotation of the third pinion gear 216 relative to the motor output shaft 202. Since the gear rack 218 is fixed relative to the guide 174, rotation of the third pinion gear 216 translates the carriage 172 along the guide 174. Accordingly, the rotation of the motor output shaft 202 results in translation of the carriage 172 along the guide 174 due to the engagement with the gear rack 218.

The lower torso massager 34 also includes a second motor 220, which is mounted to the carriage 172 and retained by the lower plate 198 and cover plate 200, which collectively define a motor mount and are fastened together by a plurality of fasteners. The second motor 220 operates to impart a massage effect from the lower torso massager 34. The second motor 220 includes a motor output shaft 222 with a worm 224 mounted to the shaft 222. The worm 224 drives a pair of worm gears 226, 228 in opposed rotational directions. Each worm gear 226, 228 is mounted for rotation on a post 230, 232 on the lower plate 198. Each worm gear 226, 228 includes a pinion gear 234, 236 mounted to an upper side thereof for rotation with the respective worm gear 226, 228. Each of the pinion gears 234, 236 are engaged with a reduction gear 238, 240 for driving the corresponding reduction gear 238, 240. The reduction gears 238, 240 are each mounted on a gear shaft 242, 244 that are rotatably mounted in the carriage 172.

Each gear shaft 242, 244 extends through the cover plate 200. A massage head 44 is mounted on each gear shaft 242, 244 with a bushing 246 between the massage head 44 and the cover plate 200 for reducing friction therebetween. Each massage head 44 includes a massage bracket 248 secured thereto. The massage brackets 248 are transversely spaced about a central longitudinal axis of the backrest 12. Each massage bracket 248 includes a large hemispherical massage node 250 and a small hemispherical massage node 252.

The massage nodes 250, 252 are each rotatable relative to their respective massage bracket 248 about an axis that is offset from that of the respective gear shaft 242, 244. The massage nodes 250, 252 extend through a corresponding aperture 46 (FIG. 2) formed through the housing forward portion 28 for imparting the massage effect to the user through the cover 16. As the massage nodes 250, 252 revolve around the corresponding gear shaft 242, 244, a rotary kneading massage effect is imparted upon the user, which is commonly referred to as a shiatsu massage.

Each massage node 250, 252 is rotatably connected to the corresponding massage bracket 248 to reduce friction generated in the rotary kneading massage effect. Further, if the first motor 196 is in operation while the second motor 220 is not in operation, the massage nodes 250, 252 will be translated in engagement along the body part of the user. The rotatably connection permits the massage nodes 250, 252 to roll along the body part, thereby creating a rolling massage effect.

Additionally, the large massage nodes 250 have an overall height greater than that of the small massage nodes 252 to extend further from the corresponding massage bracket 248. The large massage node 250 also has a greater diameter than that of the small massage node 252. These variations are utilized for varying the engagement of the rotary kneading effect with the user, resulting in a kneading effect that is non-symmetrical and similar to a massage provided by the hands of a skilled massage therapist. Additionally, these variations result in a non-symmetrical rolling massage effect as the nodes 250, 252 are rolled along the body. Additionally, a longitudinal rotary kneading massage effect is provided as the nodes 250, 252 revolve about the respective gear shaft 242, 244 and roll along the body as the carriage 172 translates along the guide 174.

Referring again to FIG. 4, the apertures 46 formed through the front housing portion 28 are generally elongate for permitting the massage nodes 250, 252 to pass therethrough as the carriage 172 is translated relative to the guide 174. Further, the cover plate 200 includes a roller bearing 254 rotatably connected thereto for engaging an underside bearing surface formed within the front housing portion 28 to provide bearing support between the carriage 172 and the front housing portion 28. Accordingly, loading that is imparted upon the backrest 12 is translated through the front housing portion 28 to the carriage 172 through the roller bearing 254.

Due to the translation of the carriages 58, 172, and the associated motors, cord management may be desired to prevent a power cord of the motors from interfering with or getting damaged by the operations of the upper and lower torso massagers 32, 34. Accordingly, a longitudinal bar 255 is provided within the backrest 12 and mounted to the rear housing portion 30. The power cords for the motors coil about the bar 255 for extension and retraction about the bar 255 as the carriages 58, 172 are translated along the respective guides 60, 174.

As illustrated in FIG. 4, the backrest 12 includes a series of limit switches 256 mounted therein for detecting the position of each of the carriages 58, 172. When one of the carriages 58, 172 reaches a limit in a range of travel, a limit switch 256 is actuated generating a signal for reversing the rotation of the first motor 78, 196 for reversing the drive direction of the respective carriage 58, 172.

The backrest 12 also includes an adapter 258, a printed circuit board (PCB) 260, and associated covers 262, 264 for providing the controls within the massager 10 and for protecting the controls by the covers 262, 264.

Figure 7:
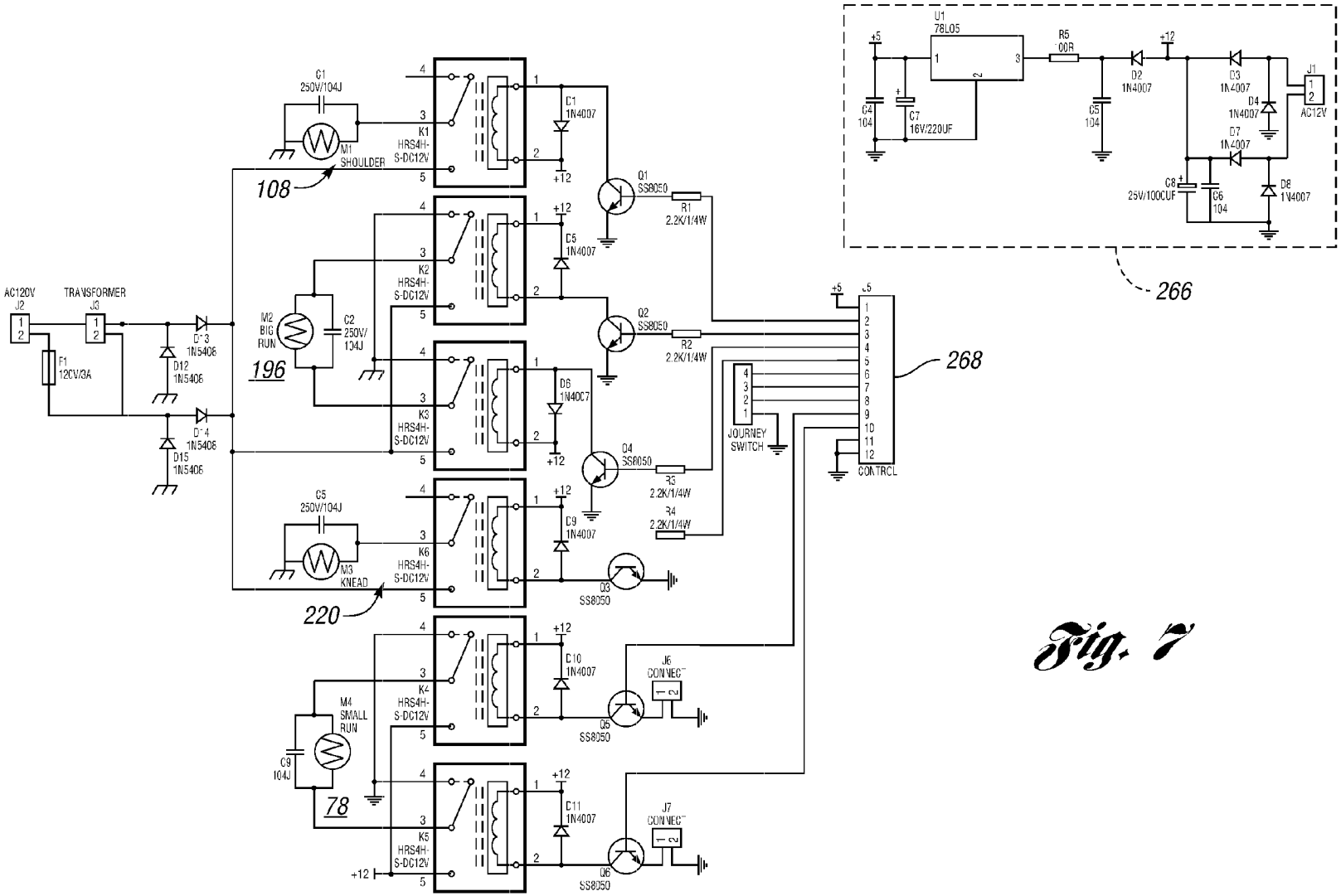
FIG. 7 is a circuit diagram of the body massager of FIG. 1.

With reference now to FIG. 7, the controls for at least one embodiment of the massager 10 are illustrated. Of course, various controls, programs and combinations of features can be employed within the scope of the present invention. An inverter 266 is provided for receiving an alternating current and outputting direct current. A controller 268 is provided for signaling the operations of the massager 10. The controller 268 (also labeled J5) provides signals to switches Q1, Q2, Q3, Q4, Q5, and Q6 for controlling the motors 78, 108, 196, and 220.

When controller 268 sends a signal from outlet port 2, switch Q1 permits power to pass through converter K1 thereby driving motor M1. Motor M1 is the second motor 108 of the upper torso massager 32 for providing the rotary massage effect.

A signal from output port 3 of controller 268 actuates switch Q2 for permitting power to be converted at K2 for driving motor M2 in a first direction. Motor M2 is the first motor 196 of the lower torso massager 34, thus driving the carriage 172 in a first direction. An output signal from output port 4 of controller 268 actuates switch Q4 for converting power at K3 and driving the motor M2 in the opposite direction for driving the motor 196 and the carriage 172 in the opposite direction.

An output signal at output port 5 of controller 268 actuates switch Q3 for converting power at K6 and driving motor M3. Motor M3 is the second motor 220 of the lower torso massager 34, thereby generating the rotary kneading massage effect of the lower massager 34.

An output signal at output port 9 of controller 268 actuates switch Q5 for converting power at K4 and driving motor M4 in a first direction. Motor M4 is the first motor 78 of the upper torso massager 32. Likewise, a signal from output port 10 of controller 268 actuates switch Q6 for converting power at K5 for driving the motor M4, 78 in a reverse direction for driving the carriage 58 along the guide 60.

Thus, various massage effects can be generated by various combinations of driving the massage motors for a rotary, rolling, or combined massage effects.

Figure 8A:
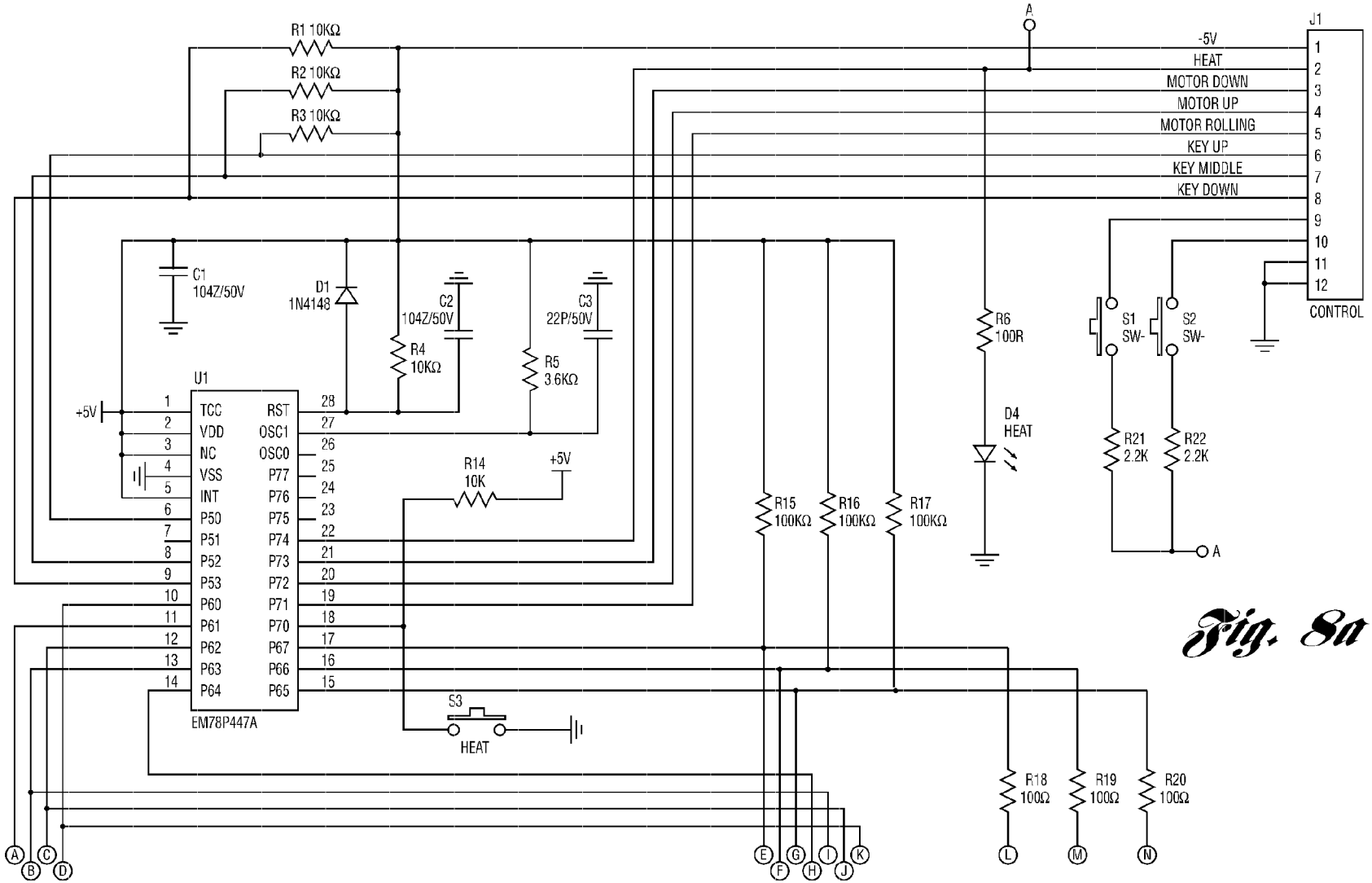
FIG. 8*a* is a portion of a circuit diagram of a manual controller for the body massager of FIG. 1.
Figure 8B:
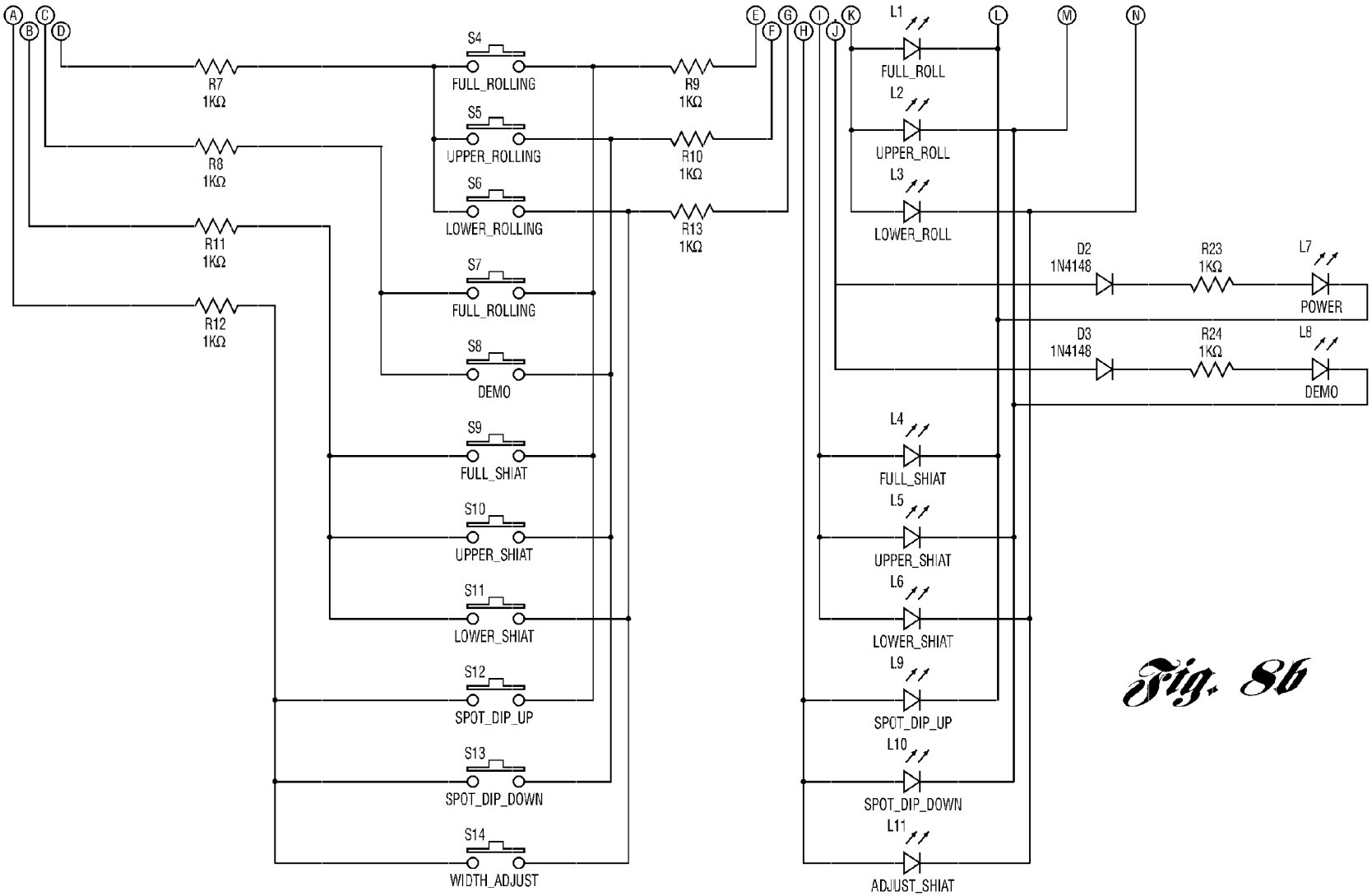
FIG. 8*b* is another portion of the circuit diagram of FIG. 8*a*.

Referring now to FIGS. 8*a* and 8*b*, a diagram is provided for at least one embodiment of a manual controller, such as a remote control of the massager 10. The diagram is separated across FIGS. 8*a* and 8*b* with connection breaks A-N of FIG. 8*a* corresponding to connection breaks A-N of FIG. 8*b*. Of course, various manual and automatic controls, programs and combinations of features can be employed within the scope of the present invention. The manual controller may employ various manual switches and light sources that indicate and operational function of the massager 10.

Manual switch S7 turns the massager 10 on and off and illuminates light-emitting diode (LED) L7 when the massager 10 is powered on.

Control J1 communicates with controller 268 for operating the massage motors. Microprocessor U1 processes signals from the manual switches to output massage programs to Control J1, and consequently controller 268.

Manual switch S3 imparts heat to an optional therapeutic heater (not shown) and illuminates diode D4.

Manual switch S4 provides full rolling by driving both carriages up and down while illuminating diode L1. Manual switch S5 provides upper rolling for driving the upper carriage 58 only and illuminating diode L2. Manual switch S6 provides lower rolling for driving the lower carriage 172 and illuminating diode L3.

Manual switch S8 provides a demo mode for a demonstration of various massager combinations and illuminates diode L8.

Manual switch S9 provides a full shiatsu massage with all four motors in operation and diode L4 illuminated. Manual switch S10 provides an upper shiatsu massage with the upper torso massager 32 providing a longitudinal rotary massage effect and with diode L5 illuminated. Manual switch S11 provides a lower shiatsu massage effect with the lower torso massager 34 and illuminates diode L6.

Manual switch S12 causes the upper carriage 58 to translate while illuminating diode L9. Manual switch S13 causes the lower carriage 172 to translate while illuminating the diode L10.

Manual switch S14 drives the massage motor 220 of the lower torso massager 34 for adjusting the width of the massage nodes 250, 252.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A body massager comprising:

a backrest having a lower torso region for receiving and supporting a lower torso of a user, and an upper torso region for receiving an upper torso of the user;

a lower torso massager oriented in the lower torso region of the backrest for imparting a massage effect to the lower torso of the user;

an upper torso massager mounted to the upper torso region for movement relative to the upper torso region, the upper torso massager extending from the upper torso region for imparting a massage effect to the upper torso of the user; and a biasing member connected to the backrest and the upper torso massager for urging the upper torso massager into contact with the user;

wherein the upper torso massager is pivotally connected to the backrest at a pivotal connection;

wherein the backrest further comprises a housing having an opening provided in a front region of the housing, wherein the upper torso massager extends and retracts through the opening; and wherein the upper torso massager further comprises:

a housing having an external contact surface, a first guide mounted to the housing and oriented generally in a longitudinal direction of the housing, a second guide mounted to the housing and oriented generally canted relative to the longitudinal direction of the housing, a carriage oriented in the housing and cooperating with the second guide for limited longitudinal translation in the housing along the second guide, a motor supported upon one of the carriage and the housing and operably connected to the other of the carriage and the housing for translating the carriage along the second guide, and at least one massage member supported on the carriage for translation relative to the carriage, the at least one massage member cooperating with the second guide such that as the carriage is translated along the first guide, the at least one massage member is translated transversely relative to the carriage along the second guide.

2. The body massager of claim 1 wherein the upper torso massager is pivotally connected to the backrest at a lower region of the upper torso massager.

3. The body massager of claim 1 wherein the pivotal connection further comprises a hinge.

4. The body massager of claim 1 wherein the pivotal connection permits the upper torso massager to pivot from generally flush with the backrest to about twelve degrees from flush with the backrest.

5. The body massager of claim 1 wherein the biasing member further comprises a coil spring.

6. The body massager of claim 1 wherein the biasing member further comprises a spring.

7. The body massager of claim 1 further comprising a transmission mounted to the carriage for receiving an input rotation and for conveying an output rotation to the at least one massage member for providing a rotary kneading massage effect, wherein the transmission further comprises at least one gearbox mounted to the carriage for movement relative to the carriage so that rotation is imparted to the at least one massage member as the at least one massage member is translated transversely relative to the carriage, wherein the at least one gearbox is pivotally connected to the carriage.

8. The body massager of claim 1 wherein the upper torso massager further comprises a rotary kneading massager that provides a massage effect along a length of the upper torso region.

9. The body massager of claim 8 wherein the lower torso massager further comprises a rotary kneading massager that provides a massage effect along a length of the lower torso region.

10. A body massager comprising:

a housing having an external contact surface for receiving a portion of a body of a user;

a first guide mounted to the housing and oriented generally in a longitudinal direction of the housing;

a carriage oriented in the housing and cooperating with the first guide for limited longitudinal translation in the housing along the first guide;

a motor supported upon one of the carriage and the housing and operably connected to the other of the carriage and the housing for translating the carriage along the first guide;

a second guide mounted to the housing and oriented generally canted relative to the longitudinal direction of the housing;

at least one massage member supported on the carriage for movement relative to the carriage, the at least one massage member cooperating with the second guide such that as the carriage is translated along the first guide, the at least one massage member is translated transversely relative to the carriage along the second guide; and a transmission mounted to the carriage for receiving an input rotation and for conveying an output rotation to the at least one massage member for providing a rotary kneading massage effect, wherein the transmission further comprises at least one gearbox mounted to the carriage for movement relative to the carriage so that rotation is imparted to the at least one massage member as the at least one massage member is translated transversely relative to the carriage;

wherein the at least one gearbox is pivotally connected to the carriage.

11. The body massager of claim 10 wherein the at least one massage member further comprises a pair of massage members that converge when translated in one direction and diverge when translated in another direction.

12. The body massager of claim 10 wherein the second guide further includes at least one slot formed through the housing external contact surface that is canted relative to the longitudinal direction, and the at least one massage member extends through the slot.

13. The body massager of claim 12 wherein the at least one slot further includes a pair of slots and the at least one massage member further comprises a pair of massage members, each extending through one of the slots, and the pair of slots are angled away from the longitudinal direction so that the pair of massage members converge when translated in one direction and diverge when translated in the other direction.

14. The body massager of claim 10 further comprising a second motor for providing the input rotation to the transmission.

15. The body massager of claim 10 wherein the transmission further comprises:

an input gear for providing the input rotation;

a first drive shaft mounted to the carriage for rotation relative to the carriage;

a first reduction gear mounted to the first drive shaft and engaged to the input gear for being driven by the input gear and consequently driving the first drive shaft;

a gearbox housing mounted to the first drive shaft to pivot relative to the carriage about the drive shaft;

a pinion gear mounted to the first drive shaft to be driven by the first drive shaft, the pinion gear being oriented within the gearbox housing;

a second drive shaft mounted to the gearbox housing for rotation relative to the gearbox housing, the second drive shaft being offset from the first drive shaft and received in an arcuate slot in the carriage for pivoting relative to the first drive shaft, the second drive shaft extending from the gearbox housing; and a second reduction gear mounted to the second drive shaft and engaged to the pinion gear for being driven by the pinion gear and consequently driving the second drive shaft;

wherein the at least one massage member is mounted to and driven by the second drive shaft.

16. The body massager of claim 15 wherein the second guide further comprises at least one slot formed through the housing external contact surface that is canted relative to the longitudinal direction, and the at least one massage member further comprises a boss mounted to the second drive shaft that extends through the slot.

* * * * *